United States Patent [19]

Kuchek

[11] 3,975,557

[45] Aug. 17, 1976

[54] PRODUCING AN ELECTRODE

[75] Inventor: Henry A. Kuchek, Auburn, Mich..

[73] Assignee: The Dow Chemical Company, Midland, Michigan

[22] Filed: Jan. 2, 1975

[21] Appl. No.: 537,871

[52] U.S. Cl. ..... 427/126; 204/290 F; 427/226

[51] Int. Cl.[2] ..... C25B 11/10

[58] Field of Search ..... 427/126, 104; 204/290 F; 252/472

[56] References Cited

UNITED STATES PATENTS 3,840,443 10/1974 Beer ..... 204/290 F 3,864,163 2/1975 Beer ..... 204/270 F

*Primary Examiner*—Ralph S. Kendall

*Attorney, Agent, or Firm*—R. W. Selby; J. M. Kuszaj

[57] ABSTRACT

A method of coating an electrode with an activating oxide comprising admixing an oxide particulate of titanium and ruthenium with a solution of titanium and ruthenium halides in an alcohol with a boiling temperature less than that of water, applying a layer of the mixture to a surface of a valve metal substrate, removing the liquid portion from the layer and then oxidizing the remaining portion of the layer.

13 Claims, No Drawings

PRODUCING AN ELECTRODE

BACKGROUND OF THE INVENTION

This invention relates to a method of producing an electrode and in particular pertains to an improved method of producing a metallic electrode coated with a ruthenium compound.

Metallic electrodes of various valve metals, such as tantalum, titanium and tungsten, have been previously employed as electrodes, i.e. either an anode or a cathode, in electrolytic processes for, for example, producing chlorine and an alkali metal hydroxide from aqueous sodium chloride containing brines, chlorates and hypochlorites. U.S. Pat. No. 3,632,498 describes the coating of such valve metals to improve the electrode performance.

Oftentimes it has been found to be necessary to apply many layers of a compound to a surface of the metal substrate to obtain a satisfactory ruthenium containing coating on the final electrode. It would be highly desirable to provide a method capable of coating a valve metal substrate with a ruthenium containing compound in a single coating step.

SUMMARY OF THE INVENTION

A ruthenium containing, electrode activating oxide, coating can be applied to a valve metal substrate in a single application by use of the hereinafter described process. The electrode formed is suitable for use in electrolytic processes, such as the production of gaseous chlorine and sodium hydroxide from an aqueous sodium chloride solution or brine in a diaphragm-type electrolytic cell.

An oxide particulate of titanium and ruthenium is admixed with a mixture consisting essentially of from about 30 to about 70 weight per cent of a titanium halide and from about 30 to about 70 weight per cent of a ruthenium halide solubilized in a liquid, water soluble alcohol having a boiling temperature less than that of water. The halides can be, for example, compounds of flourine, bromine, iodine and, preferably, chlorine. Titanium trichloride and ruthenium trichloride are preferred. Suitable alcohols are, for example, methanol, ethanol, butanol, 1-propanol and 2-propanol. Any amount of the oxide particulate in the mixture is believed to be beneficial; however, it is preferred that the mixture be a suspension containing up to 95 percent by weight oxide particulate. More preferably, the suspension contains by weight about 70 to about 90 percent oxide particulate.

At least a portion of one surface of the valve metal substrate is coated with the suspension. Coating can be carried out by well known means such as brushing, rolling, dipping, spraying and the like. Generally the coating is applied by rolling the suspension onto a surface of the substrate maintained at about room temperature.

In a preferred embodiment the oxide particulate is prepared by admixing from about 30 to about 70 per cent of a titanium halide with from about 30 to about 70 weight per cent of a ruthenium halide and dissolving the titanium and ruthenium compounds in each other or in the above described alcohol or an aqueous hydrochloric acid solution. The liquid portion of the mixture is then removed by evaporation to provide a solid precipitate containing titanium and ruthenium. The precipitate is heated to at least about 800°F, preferably to within the range of from about 800° to about 1000°F and more preferably to from about 825° to about 875°F, for a time sufficient to oxidize the precipitate. Preferably substantially all of the precipitate is oxidized to what is believed to be a mixed oxide of titanium and ruthenium. The oxidized precipitate is suitably treated by, for example, crushing, grinding, rolling and the like, to form a plurality of particles or particulate of the oxidized precipitate.

If desired, titanium trichloride can be suitably prepared by dissolving metallic titanium in an aqueous hydrochloric acid solution.

After application of the suspension to the substrate, the coating can be dried by heating such coating to a temperature of up to about 250°F for a time sufficient to remove the liquid portion from the coating. Thereafter the dried coating is further heated to at least about 800°F and preferably to within the range of from about 800° to about 1000°F and more preferably from about 825° to about 875°F for a time sufficient to form an adherent oxidized coating on the substrate and to oxidize the remaining titanium and ruthenium compounds.

EXAMPLE

A 1/16 inch thick commercially pure titanium sheet was cleaned to remove surface oxides by standard sand blasting procedures and then washed with ethanol to remove remaining contaminates, i.e. oxides or organic oils or greases, from the cleaned metal surface. The cleaned surface was sprayed with a single layer of a coating slurry. The coating slurry and the titanium surface were maintained at room temperature during spraying.

The coating slurry was prepared by mixing 100 milliliters of a hydrochloric acid solution and sufficient metallic titanium to provide a titanium ion concentration (as titanium trichloride) of 75 milligrams per milliliter of mix and combining such mix with 19.2 grams of $RuCl_3 \cdot 3H_2O$. Substantially all of the liquid contained in the titanium trichloride-ruthenium trichloride mixture was evaporated by heating to the boiling temperature of the liquid. After the evaporation step had been completed, the remaining titanium and ruthenium containing residue was heated to 850°F in an electric furnace and maintained at such temperature for a period of one hour to substantially simultaneously oxidize substantially all of the titanium and ruthenium. Thereafter the oxidized precipitate was pulverized into a fine powder by grinding in a ball mill. A final slurry, with the oxidized precipitate suspended therein, was formed by combining eight grams of the ground oxidized product with 12 milliliters of a solution containing: 100 milliliters of hydrochloric acid and sufficient metallic titanium to provide a titanium ion concentration of 75 milligrams titanium per milliliter of the HCl — Ti mixture, 19.2 grams of $RuCl_3 \cdot 3H_2O$ and 50 milliliters of ethanol.

The slurry coated surface was first dried at a temperature of 200°F for a period of 10 minutes to remove substantially all of the volatile portion of the coating. The titanium substrate, which had been substantially entirely coated with the slurry, was subsequently heated at a temperature of 850°F for one hour in an electric furnace to oxidize the remaining titanium and ruthenium compounds in the coating.

After cooling, the titanium substrate with an adherent titanium-ruthenium oxide coating thereon was placed in an electrolytic, diaphragm-type cell and found to be suitable for use as an anode in the production of chlorine and sodium hydroxide from an aqueous sodium chloride containing brine.

Substantially as described in the hereinbefore example, titanium, tantalum and tungsten substrates are coated with an adherent layer of what is believed to be a titanium-ruthenium oxide by rolling a sufficient amount of the above described slurry onto a clean, oxide-free surface of the substrate to coat a portion of the surface with the slurry. The slurry will generally contain titanium-ruthenium oxide with a size of up to about 270 U.S. Standard Sieve Series Mesh. The coated surface is thereafter heated in an air atmosphere at temperatures of 800° or 1000°F to oxidize substantially all of the titanium and ruthenium compounds. The coated substrates will be suitable for use as electrodes in electrolytic cells for producing chlorine.

What is claimed is:

1. A method for coating an electrode with an acitivating oxide comprising admixing an oxide particulate of titanium and ruthenium with a mixture consisting essentially by weight of from about 30 to about 70 percent of a titanium halide and from about 30 to about 70 weight percent of a ruthenium halide and an alcohol with a boiling temperature less than that of water; mechanically applying the oxide containing mixture to the surface of a valve metal substrate selected from the group consisting of tantalum, titanium and tungsten to coat at least a portion of the substrate with the oxide containing mixture; drying the coating; and exposing the coating to an elevated temperature for a sufficient time to oxide the titanium and ruthenium in the coating and to form in a single coating step an electrode suitable for use in the electrolytic production of chlorine and having an adherent oxide coating on at least a portion of the substrate surface.

2. The method of claim 1 wherein the valve metal is titanium.

3. The method of claim 2 wherein up to about 95 weight per cent of the oxide particulate is added to the halide containing mixture.

4. The method of claim 3 wherein the halides are chlorides.

5. The method of claim 13 wherein the titanium halide is titanium trichloride.

6. The method of claim 3 wherein the ruthenium halide is ruthenium trichloride.

7. The method of claim 2 wherein the oxide particulate is present in an amount of from about 70 to about 90 weight per cent.

8. The method of claim 2 wherein the coating is oxidized at a temperature of at least about 800°F.

9. The method of claim 2 wherein the coating is oxidized within the temperature range of from about 800° to about 1000°F.

10. The method of claim 2 wherein the coating is oxidized within the temperature range of from about 825° to about 875°F.

11. The method of claim 2 wherein drying is carried out at a temperature of up to about 250°F.

12. The method of claim 2 wherein the titanium surface to be coated is cleaned to remove surface contaminates before the coating step.

13. The method of claim 2 wherein the oxide containing mixture contains oxide particulates of titanium and ruthenium having a size of up to about 270 U.S. Standard Sieve Series Mesh.

* * * * *